US006030738A

United States Patent [19]

Michel et al.

[11] Patent Number: 6,030,738

[45] Date of Patent: Feb. 29, 2000

[54] USE OF INTER-POLYELECTROLYTE COMPLEXES AS CHARGE CONTROL AGENTS

[75] Inventors: Eduard Michel, Frankfurt; Ruediger Baur, Eppstein; Hans-Tobias Macholdt, Darmstadt-Eberstadt, all of Germany

[73] Assignee: Clariant GmbH, Frankfurt, Germany

[21] Appl. No.: 09/126,204

[22] Filed: Jul. 30, 1998

[30] Foreign Application Priority Data

Jul. 31, 1997 [DE] Germany ..... 197 32 995

[51] Int. Cl.[7] ..... G03G 9/097

[52] U.S. Cl. ..... 430/110; 430/107

[58] Field of Search ..... 430/111, 110, 430/106, 107

[56] References Cited

U.S. PATENT DOCUMENTS

| | | | |
|---|---|---|---|
| 5,187,038 | 2/1993 | Gitzel et al. | 430/110 |
| 5,314,778 | 5/1994 | Smith et al. | 430/110 |
| 5,401,809 | 3/1995 | Gitzel et al. | 525/337 |
| 5,500,323 | 3/1996 | Baur et al. | 430/110 |
| 5,502,118 | 3/1996 | Macholdt et al. | 525/437 |
| 5,788,749 | 8/1998 | Breton et al. | 106/31.6 |

FOREIGN PATENT DOCUMENTS

| | | |
|---|---|---|
| 0476647 | 3/1992 | European Pat. Off. . |
| 0576172 | 12/1993 | European Pat. Off. . |
| 0644463 | 3/1995 | European Pat. Off. . |
| 4321289 | 1/1995 | Germany . |
| 5-163449 | 6/1993 | Japan . |

OTHER PUBLICATIONS

Derwent Abstracts.

Y. Higashiyama et al. (J. Electrostatics 30(1993), pp. 203–212.

A. Singewald, L. Ernst, Zeitschrift fur Physikal. Chem., Neue Folge, vol. 124, (1981) pp. 223–248.

V.A. Kabanov, "Basic Properties of Soluble Interpolyelectrolyte Complexes Applied to Bioengineering and Cell Transformations", in "Macromolecular Complexes in Chemistry and Biology" ed. by P. Dubin, J. Bock, R.M. Davies, D.N. Schulz and C. Theis, Springer Verlag, Berlin 1994; pp.152 ff.

B. Philipp et al., "Polyelektrolyt–Komplexe–Bildungsweise, Struktur und Anwendungsmoglichkeiten" [Polyelectrolyte Complexes–Formation, Structure and Possible Application] Zeitschrift fur Chemie, (22) 1982 vol. 1, pp. 1–13.

*Primary Examiner*—John Goodrow
*Attorney, Agent, or Firm*—Susan S. Jackson

[57] ABSTRACT

Inter-polyelectrolyte complexes (IPECs) are employed as charge control agents and charge improvers in electrophotographic toners and developers, in triboelectrically or electrokinetically sprayable powders and powder coating materials and in electret materials.

8 Claims, No Drawings

USE OF INTER-POLYELECTROLYTE COMPLEXES AS CHARGE CONTROL AGENTS

BACKGROUND OF THE INVENTION

The present invention is within the technical field of charge control agents in toners and developers for electrophotographic recording processes, in powders and powder coating materials for surface coating, in electret materials, especially in electret fibers, and in separation processes.

In electrophotographic recording processes a latent charge image is produced on a photoconductor. This latent charge image is developed by applying an electrostatically charged toner which is then transferred to, for example, paper, textiles, foils or plastic and is fixed by means, for example, of pressure, radiation, heat or the action of solvent. Typical toners are one- or two-component powder toners (also known as one- or two-component developers); also used are specialty toners, such as magnetic toners, liquid toners or polymerization toners, for example. By polymerization toners are meant those toners which are formed by, for example, suspension polymerization (condensation) or by emulsion polymerization and which lead to improved particle properties in the toner.

Also meant are those toners produced in principle in nonaqueous dispersions.

One measure of the quality of a toner is its specific charge q/m (charge per unit mass). In addition to the sign and level of the electrostatic charge, the principal, decisive quality criteria are the rapid attainment of the desired charge level and the constancy of this charge over an extended activation period. In addition to this, the insensitivity of the toner to climatic effects such as temperature and atmospheric humidity is a further important criterion for its suitability.

Both positively and negatively chargeable toners are used in copiers and laser printers, depending on the type of process and type of apparatus.

To obtain electrophotographic toners or developers having either a positive or negative charge, it is common to add charge control agents. Since the charge of toner binders is in general heavily dependent on the activation period, the function of a charge control agent is, on the one hand, to set the sign and level of the toner charge and, on the other hand, to counteract the charge drift of the toner binder and to provide for constancy of the toner charge.

Charge control agents which are not able to prevent the toner or developer from showing a high charge drift (aging) during a prolonged period of use, and which may even cause the toner or developer to undergo charge inversion, are hence unsuitable for practical use.

While for black toners it is possible to employ black, blue or dark charge control agents, coloristic factors demand, for color toners, charge control agents that have no inherent color.

In the case of full color toners, in addition to the precisely defined requirements in terms of color, the three toners, yellow, cyan and magenta, must also be matched exactly to one another in terms of their triboelectric properties, since they are transferred in succession in the same apparatus.

It is known that some colorants may have a sustained effect on the triboelectric charge of toners. Because of the different triboelectric effects of colorants and the resulting effect, sometimes very pronounced, on toner chargeability, it is not possible to simply add the colorants to a toner base formulation made available at the start. On the contrary, it may be necessary to make available for each colorant an individual formulation to which the nature and amount of the required charge control agent are specifically tailored.

Since this procedure is highly laborious, there is a need for highly effective, colorless charge control agents which are able to compensate for the different triboelectric characteristics of different colorants and to give the toner the desired charge. In this way, colorants which are very different triboelectrically can be employed in the various toners required (yellow, cyan, magenta and if desired black) using one and the same charge control agent, on the basis of a toner base formulation made available at the start.

Another important practical requirement is that the charge control agents should have high thermal stability and good dispersibility. Typical temperatures at which charge control agents are incorporated into the toner resins, when using kneading apparatus or extruders, are between 100° C. and 200° C. Correspondingly, thermal stability at 200° C. is a great advantage. It is also important for the thermal stability to be ensured over a relatively long period (about 30 minutes) and in a variety of binder systems. This is significant because matrix effects occur again and again and lead to the premature decomposition of the charge control agent in the toner resin, causing the toner resin to turn dark yellow or dark brown and the charge control effect to be wholly or partly lost. Typical toner binders are addition polymerization, polyaddition and polycondensation resins, such as styrene, styrene-acrylate, styrene-butadiene, acrylate, polyester and phenol-epoxy resins, and also cycloolefin copolymers, individually or in combination, which may also include further components, examples being colorants, such as dyes and pigments, waxes or flow assistants, or may have these components added subsequently, such as highly disperse silicas.

For good dispersibility it is of great advantage if the charge control agent has minimal waxlike properties, no tackiness, and a melting or softening point of >150° C., more preferably >200° C. Tackiness leads frequently to problems in the course of the metered addition of the charge control agent to the toner formulation, and low melting or softening points may result in a failure to attain homogeneous distribution in the course of dispersing, since the material coalesces in droplets in the carrier material.

Apart from their use in electrophotographic toners and developers, charge control agents may also be used to improve the electrostatic charge of powders and coating materials, especially in triboelectrically or electrokinetically sprayed powder coatings as are used to coat surfaces of articles made from, for example, metal, wood, plastic, glass, ceramic, concrete, textile material, paper or rubber. Power coating technology is used, for example, when coating articles such as garden furniture, camping equipment, domestic appliances, vehicle parts, refrigerators and shelving and for coating workpieces of complex shape. The powder coating material, or the powder, receives its electrostatic charge, in general, by one of the two following processes:

In the corona process, the powder coating material or the powder is guided past a charged corona and is charged in the process; in the triboelectric or electrokinetic process, the principle of frictional electricity is utilized.

The powder coating material or the powder in the spray apparatus receives an electrostatic charge which is opposite to the charge of its friction partner, generally a hose or spray line made, for example, from polytetrafluoroethylene.

It is also possible to combine the two processes. Typical powder coating resins employed are epoxy resins, carboxyl- and hydroxyl-containing polyester resins, polyurethane resins and acrylic resins, together with the customary hardeners. Resin combinations are also used. For example, epoxy resins are frequently employed in combination with carboxyl- and hydroxyl-containing polyester resins.

Examples of typical hardener components for epoxy resins are acid anhydrides, imidazoles and dicyandiamide, and derivatives thereof. Examples of typical hardener components for hydroxyl-containing polyester resins are acid anhydrides, blocked isocyanates, bisacylurethanes, phenolic resins and melamine resins. For carboxyl-containing polyester resins, typical hardener components are, for example, triglycidyl isocyanurates or epoxy resins. Typical hardener components used in acrylic resins are, for example, oxazolines, isocyanates, triglycidyl isocyanurates or dicarboxylic acids.

The disadvantage of insufficient charging can be seen above all in triboelectrically or electrokinetically sprayed powders and powder coating materials which have been prepared using polyester resins, especially carboxyl-containing polyesters, or using so-called mixed powders, also referred to hybrid powders. By mixed powders are meant powder coating materials whose resin base comprises a combination of epoxy resin and carboxyl-containing polyester resin. The mixed powders form the basis for the powder coating materials used most commonly in practice. Inadequate charging of the abovementioned powders and powder coating materials results in an inadequate deposition rate and inadequate throwing power on the workpiece to be coated. The term "throwing power" is a measure of the extent to which a powder or powder coating material is deposited on the workpiece to be coated, including its rear faces, cavities, fissures and, in particular, its inner edges and corners.

It has additionally been found that charge control agents are able to improve considerably the charging and the charge stability properties of electret materials, especially electret fibers (DE-A-43 21 289). Electret fibers have hitherto been described mainly in connection with the problem of filtering very fine dusts. The filter materials described differ both in respect of the materials of which the fibers consist and with regard to the manner in which the electrostatic charge is applied to the fibers. Typical electret materials are based on polyolefins, halogenated polyolefins, polyacrylates, polyacrylonitriles, polystyrenes or fluoropolymers, for example polyethylene, polypropylene, polytetrafluoroethylene and perfluorinated ethylene and propylene, or on polyesters, polycarbonates, polyamides, polyimides, polyether ketones, on polyarylene sulfides, especially polyphenylene sulfides, on polyacetals, cellulose esters, polyalkylene terephthalates and mixtures thereof. Electret materials, especially electret fibers, can be used, for example, to filter (very fine) dusts. The electret materials can receive their charge in a variety of ways, for instance by corona or triboelectric charging.

It is additionally known that charge control agents can be used in electrostatic separation processes, especially in processes for the separation of polymers. For instance, using the example of the externally applied charge control agent trimethylphenylammonium tetraphenylborate, Y. Higashiyama et al. (J. Electrostatics 30 (1993), pp. 203–212) describe how polymers can be separated from one another for recycling purposes. Without charge control agents, the triboelectric charging characteristics of low-density polyethylene (LDPE) and high-density polyethylene (HDPE) are extremely similar. Following the addition of charge control agent, LDPE takes on a highly positive and HDPE a highly negative charge, and the materials can thus be separated easily. In addition to the external application of the charge control agents it is also possible to conceive in principle of their incorporation into the polymer in order, for example, to shift the position of the polymer within the triboelectric voltage series and to obtain a corresponding separation effect. In this way it is likewise possible to separate other polymers, such as polypropylene (PP) and/or polyethylene terephthalate (PET) and/or polyvinyl chloride (PVC), from one another.

Salt minerals, for example, can likewise be separated with particularly good selectivity if they are surface-treated beforehand (surface conditioning) with an additive which improves the substrate-specific electrostatic charging (A. Singewald, L. Ernst, Zeitschrift für Physikal. Chem., Neue Folge, Vol. 124, (1981) pp. 223–248).

Charge control agents are employed, furthermore, as electroconductivity providing agents (ECPAs) for inks in inkjet printers (JP 05 163 449-A).

Charge control agents are known from numerous literature references. However, the charge control agents known to date have a number of disadvantages, which severely limit their use in practice or even, in some cases, render it impossible; examples of such disadvantages are inherent color, instability to heat or light, low stability in the toner binder, inadequate activity in terms of the desired sign of the charge (positive or negative charging), charge level or charge constancy, and dispersibility.

SUMMARY OF THE INVENTION

The object of the present invention was thus to find improved, particularly effective, colorless charge control agents. The intention is that the compounds should not only permit the rapid attainment and constancy of the charge but should also be of high thermal stability. Furthermore, these compounds should be readily dispersible, without decomposition, in various toner binders employed in practice, such as polyesters, polystyrene-acrylates or polystyrene-butadienes/epoxy resins and also cycloolefin copolymers. In addition, the compounds should be ecologically and toxicologically unobjectionable, i.e. nontoxic and free from heavy metals. Furthermore, their action should be independent of the resin/carrier combination, in order to open up broad applicability. They should likewise be readily dispersible, without decomposition, in common powder coating binders and electret materials, such as polyester (PES), epoxy, PES-epoxy hybrid, polyurethane, acrylic systems and polypropylenes, and should not cause any discoloration of the resins.

It has surprisingly now been found that interpolyelectrolyte complexes (IPECs for short), frequently referred to just as polyelectrolyte complexes, possess good charge control properties and high thermal stability. Furthermore, these compounds are preferentially without inherent color and have good dispersibility in customary toner, powder coating and electret binders.

DESCRIPTION OF THE PREFERRED EMBODIMENTS

By IPECs are meant compounds held together by essentially ionic interactions (saltlike compounds) composed of an anionic macromolecule (polyanion) and a cationic macromolecule (polycation). They can be divided into stoichiometric and nonstoichiometric polyelectrolyte complexes. The former comprise a molar ratio of from 0.9:1.1 to 1.1:0.9, for example approximately 1:1, between cationic and anionic groups in the formation of a polymer salt, whereas in the nonstoichiometric polyelectrolyte complexes only some of the ionic groups of one polyelectrolyte component are satisfied by oppositely charged groups of the second component; the remainder are neutralized by ions of low molecular mass, examples being metal cations or inorganic anions. The nonstoichiometric IPECs are formed when the amount of a second component (guest polyelectrolyte) added to the existing solution of a first polymer component (host polyelectrolyte) is substoichiometric, i.e. under conditions where some of the ionic groups on the host macromolecule are still neutralized by counterions of low molecular mass. Such IPECs are water-soluble especially when the second component added has a substantially lower degree of polymerization than the first, existing component, and hence such a macromolecule of the second component is able to saturate, in terms of charge, only part of the polymer chain of the other component.

IPECs are known per se and are described, for example, in:

V. A. Kabanov, "Basic Properties of Soluble lnterpolyelectrolyte Complexes Applied to Bioengineering and Cell Transformations", in: "Macromolecular Complexes in Chemistry and Biology" ed. by P. Dubin, J. Bock, R. M. Davies, D. N. Schulz and C. Thies, Springer Verlag, Berlin 1994; pp. 152 ff.;

B. Philipp et al., "Polyelektrolyt-Komplexe—Bildungsweise, Struktur und Anwendungsm öglichkeiten" [Polyelectrolyte Complexes—Formation, Structure and Possible Applications] Zeitschrift für Chemie, (22) 1982, Volume 1, pp. 1–13.

IPECs find application, for example, as protein carriers, synthetic viruses, for purifying or separating proteins, as membrane materials, for influencing enzyme activities by means of complexing, and for encapsulating active substances by way of complex coacervation.

The present invention provides for the use of interpolyelectrolyte complexes as charge control agents and charge improvers in electrophotographic toners and developers, in triboelectrically or electrokinetically sprayable powders and powder coating materials, and in electret materials.

For the purposes of the present invention, both stoichiometric and nonstoichiometric polyelectrolyte complexes can be employed. In the case of the nonstoichiometric complexes it is advantageous if the excess of the relatively long-chain host polyelectrolyte is at least 20% based on the total number of charges of the IPEC.

The IPEC employed in accordance with the invention can be prepared in accordance with the information given in the literature referred to above. IPECs can be prepared, for example, by combining dilute—for example, from 0.01 to 1 molar—aqueous solutions of a polybase and a polyacid, or by combining dilute aqueous solutions of the salts of a polyacid and polybase with their low molecular mass counterions and/or with the free polybase, or by adding an ionic monomer as low molecular mass counterion onto an oppositely charged macroion and then subjecting the monomer to free-radical (matrix) polymerization. It is advantageous if the polyanionic and polycationic component can be suspended or dissolved in the aqueous medium. The IPEC is isolated, for example, by precipitation from the aqueous medium, by spray drying or by evaporative concentration, preferably by precipitation.

In the case of amino-containing polymers it may be necessary to acidify the medium in order to produce the polycation; this is the case, for example, with chitosan. In the case of carboxyl- or sulfo-containing polymers it may be necessary to alkalify the medium in order to produce the polyanion. The IPECs employed in accordance with the invention may consist essentially of synthetic and/or natural polyanions and of synthetic and/or natural polycations. The polyanions or polycations may also be derivatives of natural substances.

Examples of polyanion-forming compounds are poly (styrenesulfonic acid), poly(acrylic acid), poly(methacrylic acid), poly(maleic acid), poly(itaconic acid), poly(vinyl sulfate), poly(vinylsulfonic acid), poly(vinyl phosphate), poly(acrylic acid-co-maleic acid), poly(styrenesulfonic acid-co-maleic acid), poly(ethylene-co-acrylic acid), poly (phosphoric acid), poly(silicic acid), hectorite, bentonite, alginic acid, pectic acid, kappa-, lambda- and iota-carrageenans, xanthan, gum arabic, dextran sulfate, carboxymethyldextran, carboxymethylcellulose, cellulose sulfate, cellulose xanthogenate, starch sulfate and starch phosphate, lignosulfonates, karaya gum; polygalacturonic acid, polyglucuronic acid, polyguluronic acid, polymannuronic acid and copolymers thereof; chondroitin sulfate, heparin, heparan sulfate, hyaluronic acid, dermatan sulfate, keratan sulfate;

poly-(L)-glutamic acid, poly-(L)-aspartic acid, acidic gelatins (A-gelatins); starch, amylose, amylopectin, cellulose, guar, gum arabic, karaya gum, guar gum, pullulan, xanthan, dextran, curdlan, gellan, carubin, agarose, chitin and chitosan derivatives having the following functional groups in various degrees of substitution:

carboxymethyl and carboxyethyl, carboxypropyl, 2-carboxyvinyl, 2-hydroxy-3-carboxypropyl, 1,3-dicarboxyisopropyl, sulfomethyl, 2-sulfoethyl, 3-sulfopropyl, 4-sulfobutyl, 5-sulfopentyl, 2-hydroxy-3-sulfopropyl, 2,2-disulfoethyl, 2-carboxy-2-sulfoethyl, maleate, succinate, phthalate, glutarate, aromatic and aliphatic dicarboxylates, xanthogenate, sulfate, phosphate, 2,3-dicarboxy, N,N-di(phosphatomethyl) aminoethyl, N-alkyl-N-phosphatomethylaminoethyl. These derivatives may additionlly comprise nonionic functional groups in various degrees of substitution, such as methyl, ethyl, propyl, isopropyl, 2-hydroxyethyl, 2-hydroxypropyl and 2-hydroxybutyl groups, for example, and also esters with aliphatic carboxylic acids ($C_2$ to $C_{18}$).

The molar mass of the polyanion-forming compounds can vary within wide limits, for example from $M_w$=1000 g/mol to $M_w$=100,000,000 g/mol.

Examples of polycation-forming compounds are poly (alkylenimines), especially poly(ethylenimine), poly-(4-vinylpyridine), poly(2-vinylpyridine), poly(2-methyl-5-vinylpyridine), poly(4-vinyl-N-$C_1$–$C_{18}$-alkylpyridinium salt), poly(2-vinyl-N-$C_1$–$C_{18}$-alkylpyridinium salt), polyallylamine, polyvinylamine, aminoacetylated polyvinyl alcohol; the polymeric ammonium salts described in U.S. Pat. No. 5,401,809, obtainable by homopolymerizing monomers of the formula (I)

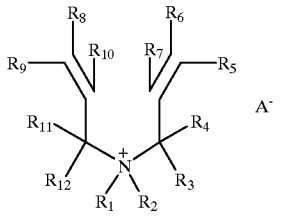

in which the radicals $R_1$ to $R_{12}$ independently of one another are a hydrogen atom, hydroxyl, a primary, secondary or tertiary amino radical, a cyano or nitro radical or a straight-chain or branched, saturated or unsaturated $C_1$–$C_{18}$-alkyl or $C_1$–$C_{18}$-alkoxy radical, and $A^-$ is an anion;

the polysulfone dialkylammonium salts described in U.S. Pat. No. 5,500,323, obtainable by copolymerizing salts of abovementioned dialkylammonium components of the formula (I) with sulfur dioxide;

poly-(L)-lysine, poly-(L)-arginine, poly(ornithine), basic gelatins (B-gelatins), chitosan; chitosan with various degrees of acetylation;

starch, amylose, amylopectin, cellulose, guar, gum arabic, karaya gum, guar gum, dextran, pullulan, xanthan, curdlan, gellan, carubin, agarose, chitin and chitosan derivatives having the following functional groups in various degrees of substitution:

2-aminoethyl, 3-aminopropyl, 2-dimethylaminoethyl, 2-diethylaminoethyl, 2-diisopropylaminoethyl, 2-dibutylaminoethyl, 3-diethylamino-2-hydroxypropyl, N-ethyl-N-methylaminoethyl, N-ethyl-N-methylaminopropyl, 2-diethylhexylaminoethyl, 2-hydroxy-2-diethylaminoethyl, 2-hydroxy-3-trimethylammonionopropyl, 2-hydroxy-3-triethylammonionopropyl, 3-trimethylammonionopropyl, 2-hydroxy-3-pyridiniumpropyl and S,S-dialkylthioniumalkyl; these derivatives may additionally comprise nonionic functional groups in various degrees of substitution, such as methyl, ethyl, propyl, isopropyl, 2-hydroxymethyl, 2-hydroxypropyl and 2-hydroxybutyl groups, for example, and also esters with aliphatic carboxylic acids ($C_2$ to $C_{18}$);

and also n,m-ionenes of the formula

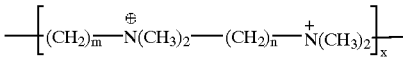

where n, m=1 to 20, x=3 to 1000;

poly(aniline); poly(pyrrole); poly(viologens) of the formula

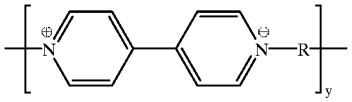

where R=alkyl, aryl and y=3 to 1000 and also poly(amidoamines) based on piperazine.

The molar mass of the polycation-forming compounds can vary within wide limits, for example from $M_w$=500 g/mol to $10^8$ g/mol.

Further examples of polyelectrolytes (anionic or cationic) are compounds of the formula

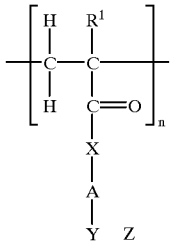

where n=from 5 to $5\times10^5$;

$R^1$=H or $CH_3$;

X=O or NH;

A=branched or linear alkylenes ($C_1$ to $C_{18}$) or arylenes e.g. phenylene or naphthylene;

Y=$NR^2_2$, $N^{\oplus}R^2_3$ where $R^2$=$C_1$–$C_8$-alkyl; $SO_3^{\ominus}$, $COO^{\ominus}$, phosphate; $N^{\oplus}R^3_2$-A-$COO^{\ominus}$, $N^{\oplus}R^3_2$-A-$SO_3^{\ominus}$, $N^{\oplus}R^3_2$-A-PO(OH)$O^{\ominus}$ where $R^3$=$C_1$–$C_8$-alkyl;

Z=anion, e.g. halide, methyl sulfate, sulfate, phosphate; or cation, e.g. metal cation such as $Na^+$ or $K^+$, or quaternary ammonium compound;

and also copolymers consisting of monomers of the abovementioned compounds and one of the following monomers in various compositions: acrylic acid, methacrylic acid, acrylic acid alkyl($C_1$–$C_{18}$) esters, methacrylic acid alkyl ($C_1$–$C_{18}$) esters, acrylamide, acrylonitrile, ethylene, styrene, butadiene, isoprene, vinyl chloride, propylene, maleic anhydride, maleic acid monoalkyl($C_1$–$C_{18}$) or dialkyl ($C_1$–$C_{18}$) esters, alkyl($C_1$–$C_{18}$) vinyl ethers, vinyl alcohol, vinyl acetate, vinylimidazole, N-vinyl-2-caprolactam, N-vinylpyrrolidone, mono- or dialkylated ($C_1$–$C_{30}$) N-vinylpyrrolidone.

Particular preference is given to chitosan, which is usually formed by treating chitin with concentrated sodium hydroxide solution, with cleavage of the N-acetyl bond. Chitosan with free amino groups is insoluble in water. By forming salts with acids chitosonium salts are formed which are water-soluble cationic polyelectrolytes.

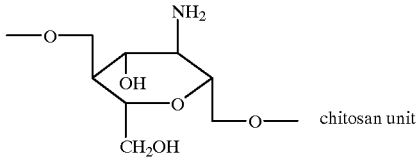

The IPECs used in accordance with the invention can be matched precisely to the particular resin/toner system. A further factor is that the compounds employed in accordance with the invention are colorless and free-flowing and possess high and particularly constant charge control properties, good thermal stabilities and good dispersibilities. A further technical advantage of these compounds is that they are inert toward the various binder systems and can therefore be employed widely.

Dispersion means the distribution of one substance within another, i.e. in the context of the invention the distribution of a charge control agent in the toner binder, powder coating binder or electret material.

It is known that crystalline substances in their coarsest form are present as agglomerates. To achieve homogeneous distribution within the binder, these agglomerates must be disrupted by the dispersing operation into smaller aggregates or, ideally, into primary particles. The particles of charge control agent present in the binder following dispersion should be smaller than 1 μm, preferably smaller than 0.5 μm, with a narrow particle size distribution being of advantage.

For the particle size, defined by the $d_{50}$ value, there are optimum ranges of activity depending on the material. For instance, coarse particles (~1 mm) can in some cases not be dispersed at all or can be dispersed only with a considerable investment of time and energy, whereas very fine particles in the submicron range harbor a heightened safety risk, such as the possibility of dust explosion.

The particle size and form is established and modified either by the synthesis and/or by aftertreatment. The required property is frequently possible only through controlled aftertreatment, such as milling and/or drying. Various milling techniques are suitable for this purpose. Examples of advantageous technologies are air jet mills, cutting mills, hammer mills, bead mills and impact mills.

The binder systems mentioned in connection with the present invention are, typically, hydrophobic materials. High water contents in the charge control agent can either oppose wetting or else promote dispersion (flushing). The practicable moisture content is therefore specific to the particular material.

The compounds of the invention feature the following chemical/physical properties: The water content, determined by the Karl-Fischer method, is between 0.1% and 30%, preferably between 1 and 25% and, with particular preference, between 1 and 20%, it being possible for the water to be in adsorbed and/or bonded form, and for its proportion to be adjusted by the action of heat at up to 200° C. and reduced pressure down to $10^{-8}$ torr or by addition of water.

The particle size, determined by means of evaluation by light microscope, or by laser light scattering, and defined by the $d_{50}$ value, is between 0.01 μm and 1000 μm, preferably between 0.1 and 500 μm and, with very particular preference, between 0.5 and 400 μm.

It is particularly advantageous if milling results in a narrow particle size. Preference is given to a range $\Delta(d_{95}-d_{50})$ of less then 500 μm, in particular less than 200 μm.

The IPECs used in accordance with the invention, as colorless, readily dispersible charge control agents, are particularly suitable for color toners in combination with colorants. Suitable colorants in this context are inorganic pigments, organic dyes, organic color pigments, and also white colorants, such as $TiO_2$ or $BaSO_4$, pearl luster pigments and black pigments, based on carbon black or iron oxides.

The compounds used in accordance with the invention are incorporated individually or in combination with one another in a concentration of from 0.01 to 50% by weight, preferably from 0.5 to 20% by weight and, with particular preference, from 0.1 to 5.0% by weight, based on the overall mixture, into the binder of the respective toner, developer, coating material, powder coating material, electret material or of the polymer which is to be electrostatically separated, said incorporation being by means of extrusion or kneading. In this context the compounds employed in accordance with the invention can be added as dried and milled powders, dispersions or solutions, presscakes, masterbatches, preparations, made-up pastes, as compounds applied from aqueous or nonaqueous solution to appropriate carriers such as silica gel, $TiO_2$ or $Al_2O_3$, for example, or in some other form. Similarly, the compounds used in accordance with the invention can also in principle be added even during the preparation of the respective binders, i.e. in the course of their addition polymerization, polyaddition or polycondensation.

The present invention additionally provides an electrophotographic toner, powder or powder coating material comprising a customary binder, for example a styrene, styrene-acrylate, styrene-butadiene, acrylate, urethane, acrylic, polyester or epoxy resin or a combination of the latter two, and from 0.01 to 50% by weight, preferably from 0.5 to 20% by weight and, with particular preference, from 0.1 to 5% by weight, based in each case on the total weight of the electrophotographic toner, powder or powder coating material, of at least one inter-polyelectrolyte complex.

In the case of processes for the electrostatic separation of polymers and, in particular, of (salt) minerals the IPECs can also be applied, in the abovementioned quantities, externally, i.e. to the surface of the material to be separated.

PREPARATION EXAMPLES

The mol* data relate to average charge units, i.e. the "monomer unit" is regarded as being those sections which carry precisely one charge. Percentages are by weight.

Preparation Example 1

20 g of a 25% strength aqueous solution of poly (vinylsulfonic acid) Na salt (0.038 mol*, average molar mass about 100,000 g/mol) were diluted with 250 ml of deionized water, with stirring. Then, at room temperature and likewise with stirring, 15.5 g of a 40% strength aqueous solution of poly(diallyldimethylammonium chloride) (0.038 mol*, average molar mass about 70,000 g/mol) in 100 ml of deionized water were added dropwise over the course of 10 minutes. A light brownish precipitate was formed. This precipitate was stirred for 1 hour, filtered off, washed repeatedly with deionized water and then dried at 60° C. and 100 mbar for 24 hours.

Yield: 8.9 g (79% of theory)

Preparation Example 2

5 g (0.012 mol*) of diethylaminoethyl dextran (DEAE-dextran) (DS=0.63, average molar mass about 500,000 g/mol) were dissolved at room temperature in 250 ml of deionized water. Then, with stirring, 3.8 g (0.012 mol*) of carboxymethylcellulose (DS=0.78, average molar mass about 400,000 g/mol) were added dropwise over the course of 10 minutes. The resulting white precipitate was stirred for 1 hour, then filtered off, washed with 500 ml of deionized water and subsequently dried at 60° C. and 100 mbar for 24 hours.

DTA: 204° C. (decomposition point)

| | | |
|---|---|---|
| Elemental analysis: | calculated: | 48.0% C, 7.0% H, 1.9% N, 43.1% O, 0% Na |
| | found: | 43.9% C, 7.1% H, 1.9% N, 46.4% O, 0.23% Na |

Preparation Example 3: (Example of a nonstoichiometric IPEC)

7.5 g (0.047 mol*) of chitosan (average molar mass about 400,000 g/mol) were dissolved in 500 ml of 1% strength acetic acid, and then 1000 ml of deionized water were added to this solution. Subsequently, with stirring and at room temperature, 4.4 g (0.047 mol*) of poly(acrylic acid) Na salt (average molar mass about 30,000 g/mol), dissolved in 100 ml of deionized water, were added dropwise over the course of 10 minutes. The resulting white precipitate was stirred for one hour and then filtered off on a 250 μm sieve, washed and subsequently dried at 60° C. and 100 mbar for 24 hours. The ratio of chitosan to poly(acrylic acid) was found to be approximately 1:4.

Preparation Example 4

5.0 g (0.116 mol*) of poly(ethylenimine), average molar mass about 750,000 g/mol, were dissolved in 300 ml of deionized water, with the addition of 20 ml of 90% strength acetic acid, with stirring and at room temperature. Then, likewise with stirring, a solution of 21.1 g (0.116 mol*) of poly(styrenesulfonic acid) Na salt, average molar mass about 70,000 g/mol, in 250 ml of deionized water was added dropwise over the course of 10 minutes. Toward the end of the dropwise addition, 200 ml of deionized water were added to the resulting white suspension in order to dilute it. The suspension was subsequently stirred for 1 hour, and filtered and the white precipitate was washed with 500 ml of deionized water and then dried at 60° C. and 100 mbar for 24 hours.

Yield: 21.9 g (76% of theory)

Preparation Examples 5–18

The preparation examples below were carried out in analogy to one of the above-described preparation examples but with different proportions. The amounts of the components added are summarized in Table 1.

TABLE 1

| Example No. | Polyanion component and amount*) | Polycation component and amount*) | Analogous to Ex. |
|---|---|---|---|
| 5 | poly(styrenesulfonic acid), Na salt 4.5 g (0.041 mol) DTA: 313° C. (decomposition point) | poly(DADMAC) 6.7 g (0.041 mol) | 1 |
| 6 | poly(acrylic acid), Na salt 5.0 g (0.053 mol) | poly(DADMAC) 8.6 g (0.053 mol) | 1 |
| 7 | poly(styrenesulfonic acid-co-maleic acid 1:1), Na salt 10.0 g (0.088 mol) | poly(DADMAC) 4.4 g (0.088 mol) | 2 |
| 8 | poly(styrenesulfonic acid-co-maleic acid 3:1), Na salt 5.0 g (0.035 mol) | poly(DADMAC) 5.7 g (0.035 mol) | 1 |
| 9 | gum arabic 10.0 g (0.015 mol) | poly(DADMAC) 2.4 g (0.015 mol) | 2 |
| 10 | carboxymethylcellulose, Na salt (DS = 0.78) 10 g (0.032 mol) | poly(DADMAC) 5.2 g (0.032 mol) | 1 |
| 11 | poly(styrenesulfonic acid-co-maleic acid 3:1), Na salt 4.4 g (0.031 mol) | chitosan 5.0 g (0.031 mol) | 3 |
| 12 | gum arabic 8.5 g (0.012 mol) | DEAE-dextran (DS = 0.63) 5.0 g (0.012 mol) | 1 |
| 13 | poly(styrenesulfonic acid-co-maleic acid 1:1), Na salt 3.6 g (0.031 mol) | chitosan 5 g (0.031 mol) | 3 |
| 14 | xanthan 10.9 g (0.016 mol) | chitosan 2.5 g (0.016 mol) | 3 |
| 15 | carboxymethylcellulose, Na salt (DS = 0.78) 9.7 g (0.031 mol) | chitosan 5.0 g (0.031 mol) | 3 |
| 16 | carrageenan 8.2 g (0.031 mol) | chitosan 5.0 g (0.031 mol) | 3 |
| 17 | dextran sulfate, Na salt 11.6 g (0.031 mol) | chitosan 5.0 g (0.031 mol) | 3 |
| 18 | poly(acrylic acid), Na salt 10.9 g (0.116 mol) | poly (ethylenimine) 5.0 g (0.116 mol) | 4 |

*)Molar amounts relate to the average charge unit
DADMAC = Diallyldimethylammonium chloride
DS = Degree of substitution
DEAE = Diethylaminoethyl Table 2 below gives various analytical data, by way of example, for the IPECs employed in accordance with the invention, on the basis of four of these compounds.

TABLE 2

| No | Inter-polyelectrolyte complex | C [mS] | pH | $H_2O$ content [%] | DTA $T_{decomp}$ [° C.] | $C_o$ [pF] | R [Ω] | Particle size distribution $d_{50}$-Wert |
|---|---|---|---|---|---|---|---|---|
| 1 | poly(DADMAC) + poly(styrenesulfonic acid) | 10.39 | 4.25 | 10.7 | 313 | 4.4 | $<10^5$ | 223 μm |
| 2 | chitosan + xanthan | 1.60 | 4.63 | 10.5 | 218 | 3.86 | $4 \cdot 10^6$ | 372 μm |
| 3 | DEAE-dextran + carboxymethylcellulose | 0.31 | 5.92 | 2.5 | 204 | — | — | — |
| 4 | chitosan + poly(acrylic acid) | 1.97 | 5.0 | 4.2 | 278 | — | — | — |

C = Conductivity
$C_o$ = Capacitance

Use Examples

In the following use examples the following toner binders and carriers are employed:

Toner Binders:

Resin 1: 60:40 styrene-methacrylate copolymer

Resin 2: Bisphenol-based polyester (®Almacryl resin)

Carriers:

Carrier 1: Styrene-methacrylate copolymer-coated magnetite particles of size 50 to 200 μm (bulk density 2.62 g/cm$^3$) (FBM 100 A; from Powder Techn.).

Carrier 2: Silicone-coated ferrite particles of size 50 to 100 μm (bulk density 2.75 g/cm$^3$) (FBM 96-110; from Powder Techn.)

Use Example 1–3 and 5–17

1 part of each IPEC is incorporated homogeneously over the course of 45 minutes, using a kneader, into 99 parts of a toner binder (60:40 styrene-methacrylate copolymer, resin 1, ®Dialec S 309). The composition is then milled on a laboratory universal mill and subsequently classified in a centrifugal classifier. The desired particle fraction (4 to 25 μm) is activated with a carrier (Carrier 1).

Use Examples 4 and 18

1 part of each IPEC is incorporated homogeneously over the course of 45 minutes, using a kneader, into 99 parts of a toner binder (biphenyl-based polyester, resin 2, ®Almacryl resin). The composition is then milled on a laboratory universal mill and subsequently classified in a centrifugal classifier. The desired particle fraction (4 to 25 μm) is activated with Carrier 2.

Electrostatic Testing:

Measurement is carried out on a customary q/m measurement stand. By using a sieve having a mesh size of 50 μm it is ensured that no carrier is entrained when the toner is blown out. Measurements are carried out at 50% relative atmospheric humidity. The q/m values [μC/g] are measured as a function of the activation period. The q/m values are given in Table 3. The amounts of IPEC are in each case 1% by weight.

TABLE 3

| IPEC from Preparation | | | q/m [μC/g] after activation time of | | | |
|---|---|---|---|---|---|---|
| Example No. | Resin | Carrier | 10 min | 30 min | 2 h | 24 h |
| 1 | 1 | 1 | −9.8 | −21.5 | −36.3 | −35.3 |
| 2 | 1 | 1 | −10.8 | −17.7 | −30.4 | −32.9 |
| 3 | 1 | 1 | −16.7 | −22.0 | −28.7 | −30.0 |
| 4 | 2 | 2 | −10.2 | −7.4 | −6.9 | −6.4 |
| 5 | 1 | 1 | −10.0 | −20.0 | −33.4 | −38.8 |
| 6 | 1 | 1 | −13.2 | −24.5 | −36.3 | −41.2 |
| 7 | 1 | 1 | −9.9 | −16.1 | −32.2 | −37.9 |
| 8 | 1 | 1 | −8.4 | −15.1 | −31.1 | −38.3 |
| 9 | 1 | 1 | −8.8 | −16.5 | −28.6 | −32.0 |
| 10 | 1 | 1 | −8.1 | −13.3 | −24.1 | −32.6 |
| 11 | 1 | 1 | −5.6 | −11.7 | −22.9 | −32.0 |
| 12 | 1 | 1 | −12.6 | −20.2 | −28.7 | −27.1 |
| 13 | 1 | 1 | −15.5 | −19.6 | −26.5 | −31.3 |
| 14 | 1 | 1 | −6.5 | −11.2 | −18.0 | −24.8 |
| 15 | 1 | 1 | −7.2 | −12.8 | −22.4 | −29.5 |
| 16 | 1 | 1 | −5.2 | −8.0 | −12.1 | −13.4 |
| 17 | 1 | 1 | −8.9 | −14.0 | −21.1 | −22.1 |
| 18 | 2 | 2 | −15.0 | −13.1 | −12.8 | −12.6 |

Use Examples for Triboelectric Powder Spraying:

Use Example 19

1 part of the compound from Preparation Example 6 was incorporated homogeneously into 99 parts of a powder coating binder (resin 1), as described for Use Examples 1 to 3. The triboelectric spraying of the powders (powder coating materials) was carried out with a spraying apparatus such as the ®Tribo Star from Intec (Dortmund, Germany), having a standard spraying pipe and a star-shaped interior rod, at maximum powder throughput with a spray pressure of 3 and 5 bar. For this purpose, the article to be sprayed was suspended in a spraybooth and sprayed directly from the front from a distance of about 20 cm without further movement of the spraying apparatus. The respective charge of the sprayed powder was subsequently measured with a device from Intec for measuring the triboelectric charge of powders. For the measurement, the antenna of the measuring device was held directly in the cloud of powder emerging from the spraying device. The current strength resulting from the electrostatic charge of powder coating or powder was indicated in μA. The deposition rate was subsequently determined, in %, by differential weighing of the sprayed and deposited powder coating material.

| Pressure [bar] | Current [μA] | Deposition rate [%] |
|---|---|---|
| 3 | 2.2–2.6 | 45.6 |
| 5 | 4.2–4.6 | 43.6 |

Use Example 20

The procedure of Use Example 19 was repeated but using the IPEC from Preparation Example 4 and Resin 2.

| Pressure [bar] | Current [μA] | Deposition rate [%] |
|---|---|---|
| 3 | 0.4–0.7 | 17.2 |
| 5 | 0.4–0.7 | 30.7 |

We claim:

1. A method of controlling and improving charge of electrophotographic toners and developers, of triboelectrically or electrokinetically sprayable powders and powder coating materials, and of electret materials, comprising:

adding an inter-polyelectrolyte complex to said electrophotographic toners and developers, to triboelectrically or electrokinetically sprayable powders and powder coating materials, and to electret materials wherein said inter-polyelectrolyte complex comprises one or more polyanion-forming compound and one or more polycation-forming compound and wherein said polyanion-forming compound is hectorite, bentonite, alginic acid, pectic acid, carrageenan, xanthan, gum arabic, dextran sulfate, carboxymethyldextran, carboxymethylcellulose, cellulose sulfate, cellulose xanthogenate, starch sulfate, starch phosphate, lignosulfonate, karaya gum; polygalacturonic acid, polyglucuronic acid, polyguluronic acid, polymannuronic acid, chondroitin sulfate, heparin, heparan sulfate, hyaluronic acid, dermatan sulfate, keratan sulfate; poly-(L)-glutamic acid, poly-(L)-aspartic acid, acidic gelatins (A-gelatins); starch, amylose, amylopectin, cellulose, guar, gum arabic, karaya gum, guar gum, pullulan, xanthan, dextran, curdlan, gellan, carubin, agarose, chitin or chitosan derivatives having the following functional groups: carboxymethyl, carboxyethyl, carboxypropyl, 2-carboxyvinyl, 2-hydroxy-3-carboxypropyl, 1,3-dicarboxyisopropyl, sulfomethyl, 2-sulfoethyl, 3-sulfopropyl, 4-sulfobutyl, 5-sulfopentyl, 2-hydroxy-3-sulfopropyl, 2,2-disulfoethyl, 2-carboxy-2-sulfoethyl, maleate, succinate, phthalate, glutarate, aromatic and aliphatic dicarboxylates, xanthogenate, sulfate, phosphate, 2,3-dicarboxy, N,N-di(phosphatomethyl)aminoethyl and N-alkyl-N-phosphatomethylaminoethyl.

2. The method as claimed in claim 1, wherein the molar ratio of polymeric cationic to polymeric anionic groups in the inter-polyelectrolyte complex is from 0.9:1.1 to 1.1:0.9.

3. The method as claimed in claim 1, wherein the polycation-forming compounds are selected from the group consisting of poly(alkylenimines); poly-(4-vinylpyridine); poly(vinylamine); poly(2-vinylpyridine), poly(2-methyl-5-vinylpyridine), poly(4-vinyl-N-$C_1$–$C_{18}$-alkylpyridinium salt), poly(2-vinyl-N-$C_1$–$C_{18}$-alkylpyridinium salt), polyallylamine, aminoacetylated polyvinyl alcohol; of polymeric ammonium salts obtainable by homopolymerizing monomers of the formula (I)

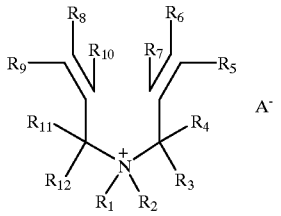

in which the radicals $R_1$ to $R_{12}$ independently of one another are a hydrogen atom, hydroxyl, a primary, secondary or tertiary amino radical, a cyano or nitro radical or a straight-chain or branched, saturated or unsaturated $C_1$–$C_{18}$-alkyl or $C_1$–$C_{18}$-alkoxy radical, and $A^-$ is an anion;

of polysulfone dialkylammonium salts obtainable by copolymerizing monomers of the formula (I) with sulfur dioxide;

poly-(L)-lysine, poly-(L)-arginine, poly(ornithine), basic gelatins (B-gelatins), chitosan; acetyl chitosan;

starch, amylose, amylopectin, cellulose, guar, gum arabic, karaya gum, guar gum, dextran, pullulan, xanthan, curdlan, gellan, carubin, agarose, chitin or chitosan derivatives having the following functional groups:

2-aminoethyl, 3-aminopropyl, 2-dimethylaminoethyl, 2-diethylaminoethyl, 2-diisopropylaminoethyl, 2-dibutylaminoethyl, 3-diethylamino-2-hydroxypropyl, N-ethyl-N-methylaminoethyl, 2-diethylhexylaminoethyl, 2-hydroxy-2-diethylaminoethyl, 2-hydroxy-3-trimethylammonionopropyl, 2-hydroxy-3-triethylammonionopropyl, 3-trimethylammonionopropyl, 2-hydroxy-3-pyridiniumpropyl, S,S-dialkylthioniumalkyl;

n,m-ionenes of the formula

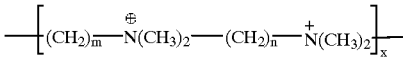

where n, m=1 to 20, x=3 to 1000; poly(aniline); poly (pyrrole); poly(viologens) of the formula

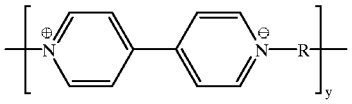

where R=alkyl, aryl and y=3 to 1000 and poly (amidoamines) based on piperazine.

4. The method as claimed in claim 1, wherein the inter-polyelectrolyte complex consists essentially of a polyanion-forming compound selected from the group consisting of hectorite, gum arabic, carboxymethylcellulose, xanthan, carrageenan and dextran sulfate; and of a polycation-forming compound selected from the group consisting of poly (diallyldimethylammonium), chitosan, diethylaminoethyl-dextran and poly(ethylenimine).

5. The method as claimed in claim 1, wherein the inter-polyelectrolyte complex is incorporated in a concentration of from 0.01 to 50% by weight, based on the overall mixture, into the binder of the respective toner, developer, coating material, powder coating material or electret material.

6. The method as claimed in claim 1, wherein the inter-polyelectrolyte complex is incorporated in a concentration of from 0.5 to 20% by weight, based on the overall mixture, into the binder of the respective toner, developer, coating material, powder coating material or electret material.

7. An electrophotographic toner, powder or powder coating material comprising a styrene, styrene-acrylate, styrene-butadiene, acrylate, urethane, acrylic, polyester or epoxy resin or a combination of the latter two, and from 0.01 to 50% by weight, based in each case on the total weight of the electrophotographic toner, powder or powder coating material, of at least one inter-polyelectrolyte complex wherein said inter-polyelectrolyte complex comprises one or more polyanion-forming compound and one or more polycation-forming compound and wherein said polyanion-forming compound is hectorite, bentonite, alginic acid, pectic acid, carrageenan, xanthan, gum arabic, dextran sulfate, carboxymethyldextran, carboxymethylcellulose, cellulose sulfate, cellulose xanthogenate, starch sulfate, starch phosphate, lignosulfonate, karaya gum; polygalacturonic acid, polyglucuronic acid, polyguluronic acid, polymannuronic acid, chondroitin sulfate, heparin, heparan sulfate, hyaluronic acid, dermatan sulfate, keratan sulfate; poly-(L)-glutamic acid, poly-(L)-aspartic acid, acidic gelatins (A-gelatins); starch, amylose, amylopectin, cellulose, guar, gum arabic, karaya gum, guar gum, pullulan, xanthan, dextran, curdlan, gellan, carubin, agarose, chitin or chitosan derivatives having the following functional groups: carboxymethyl, carboxyethyl, carboxypropyl, 2-carboxyvinyl, 2-hydroxy-3-carboxypropyl, 1,3-dicarboxyisopropyl, sulfomethyl, 2-sulfoethyl, 3-sulfopropyl, 4-sulfobutyl, 5-sulfopentyl, 2-hydroxy-3-sulfopropyl, 2,2-disulfoethyl, 2-carboxy-2-sulfoethyl, maleate, succinate, phthalate, glutarate, aromatic and aliphatic dicarboxylates, xanthogenate, sulfate, phosphate, 2,3-dicarboxy, N,N-di(phosphatomethyl)aminoethyl and N-alkyl-N-phosphatomethylaminoethyl.

8. An electrophotographic toner, powder or powder coating material comprising a styrene, styrene-acrylate, styrene-butadiene, acrylate, urethane, acrylic, polyester or epoxy resin or a combination of the latter two, and from 0.5 to 20% by weight, based in each case on the total weight of the electrophotographic toner, powder or powder coating material, of at least one inter-polyelectrolyte complex wherein said inter-polyelectrolyte complex comprises one or more polyanion-forming compound and one or more polycation-forming compound and wherein said polyanion-forming compound is hectorite, bentonite, alginic acid, pectic acid, carrageenan, xanthan, gum arabic, dextran sulfate, carboxymethyldextran, carboxymethylcellulose, cellulose sulfate, cellulose xanthogenate, starch sulfate, starch phosphate, lignosulfonate, karaya gum; polygalacturonic acid, polyglucuronic acid, polyguluronic acid, polymannuronic acid, chondroitin sulfate, heparin, heparan sulfate, hyaluronic acid, dermatan sulfate, keratan sulfate; poly-(L)-glutamic acid, poly-(L)-aspartic acid, acidic gelatins (A-gelatins); starch, amylose, amylopectin, cellulose, guar, gum arabic, karaya gum, guar gum, pullulan, xanthan, dextran, curdlan, gellan, carubin, agarose, chitin or chitosan derivatives having the following functional groups: carboxymethyl, carboxyethyl, carboxypropyl, 2-carboxyvinyl, 2-hydroxy-3-carboxypropyl, 1,3-dicarboxyisopropyl, sulfomethyl, 2-sulfoethyl, 3-sulfopropyl, 4-sulfobutyl, 5-sulfopentyl, 2-hydroxy-3-sulfopropyl, 2,2-disulfoethyl, 2-carboxy-2-sulfoethyl, maleate, succinate, phthalate, glutarate, aromatic and aliphatic dicarboxylates, xanthogenate, sulfate, phosphate, 2,3-dicarboxy, N,N-di(phosphatomethyl)aminoethyl and N-alkyl-N-phosphatomethylaminoethyl.

* * * * *